US012133555B2

(12) United States Patent
Newton

(10) Patent No.: US 12,133,555 B2
(45) Date of Patent: Nov. 5, 2024

(54) PRESSURE EQUALIZING VAPORIZER CARTRIDGE

(71) Applicant: Kyle D. Newton, Euless, TX (US)

(72) Inventor: Kyle D. Newton, Euless, TX (US)

(73) Assignee: Kyle Newton, Euless, TX (US)

( * ) Notice: Subject to any disclaimer, the term of this patent is extended or adjusted under 35 U.S.C. 154(b) by 450 days.

(21) Appl. No.: 17/482,679

(22) Filed: Sep. 23, 2021

(65) Prior Publication Data

US 2023/0093305 A1 Mar. 23, 2023

(51) Int. Cl.

| | |
|---|---|
| ***A24F 40/42*** | (2020.01) |
| ***A24F 40/10*** | (2020.01) |
| ***A24F 40/51*** | (2020.01) |
| ***A24F 40/60*** | (2020.01) |

(52) U.S. Cl.

CPC ..... *A24F 40/42* (2020.01); *A24F 40/10* (2020.01); *A24F 40/51* (2020.01); *A24F 40/60* (2020.01)

(58) Field of Classification Search

CPC ..... A24F 40/10; A24F 40/42; A24F 40/48; A24F 40/51; A24F 40/60

See application file for complete search history.

(56) References Cited

U.S. PATENT DOCUMENTS

| | | | | |
|---|---|---|---|---|
| 10,285,449 | B2 * | 5/2019 | Murison | A61M 11/042 |
| 10,624,392 | B2 | 4/2020 | Batista et al. | |
| 10,791,761 | B2 * | 10/2020 | Davis | A24F 40/44 |
| 11,109,622 | B1 * | 9/2021 | Woodbine | A61M 15/0021 |
| 2014/0150810 | A1 * | 6/2014 | Hon | H04R 1/028 131/329 |
| 2018/0015242 | A1 * | 1/2018 | Goodman | A24F 40/53 |
| 2019/0041086 | A1 * | 2/2019 | Atkins, Jr. | F24F 6/14 |
| 2019/0208811 | A1 * | 7/2019 | Biel | A24F 15/015 |
| 2020/0060342 | A1 * | 2/2020 | Woodbine | A24F 40/30 |
| 2021/0023315 | A1 * | 1/2021 | Goldenberg | A61M 15/0025 |
| 2021/0298362 | A1 * | 9/2021 | Woodbine | A24F 40/485 |
| 2022/0322745 | A1 * | 10/2022 | Ireland | A24F 40/44 |
| 2023/0120935 | A1 * | 4/2023 | Davidson | G06V 40/00 |
| 2023/0346036 | A1 * | 11/2023 | Chan | A24F 40/48 |

* cited by examiner

*Primary Examiner* — Abdullah A Riyami
*Assistant Examiner* — Thang H Nguyen
(74) *Attorney, Agent, or Firm* — Fish & Richardson P.C.

(57) ABSTRACT

This disclosure describes a personal vaporizer such as an electronic cigarette, electronic nicotine delivery system that includes a movable ceiling, which can be adjusted to compensate for changes in ambient barometric pressure. Personal vaporizers can provide controlled substances (e.g., nicotine, Tetrahydrocannabinol (THC), Cannabidiol (CBD), etc.). In many personal vaporizers, a wick transports the substance to be atomized from a reservoir to an atomization chamber via capillary action. In condition where a sufficient differential pressure between the atomization chamber, typically at ambient pressure, and the reservoir exists, the substance can leak from the reservoir into the atomization chamber without being drawn out by airflow (e.g., the user inhaling on the mouthpiece). A movable wall within the cartridge of the personal vaporizer can be used to adjust the volume of the reservoir, and reduce differential pressure between the reservoir and the ambient pressure, minimizing or eliminating unwanted leaks due to pressure changes.

19 Claims, 3 Drawing Sheets

$P_{ambient}$ = Normal (e.g., 14.2 PSIA)
202
Range of Travel
230
Movable Ceiling
238
Equalizing Vent $P_{ambient}$ = Low (e.g., 10.1 PSIA)
204
Cartridge $P_{ambient}$ = Normal (e.g., 14.2 PSIA)

PRESSURE EQUALIZING VAPORIZER CARTRIDGE

BACKGROUND

Personal vaporizers provide an alternative to smoking techniques, which involve combustion of organic matter and inhalation of the smoke. Instead vaporizers atomize a substance (e.g., a nicotine substance or cannabis substance) using a heating element to simulate the combustion found in traditional cigarettes. Personal vaporizers often use removable/replaceable cartridges containing a substance for atomization.

SUMMARY

The present disclosure encompasses systems, methods, and an apparatus for inhaling vaporized substances. A personal vaporizer is disclosed that includes a body with a power supply, a motor, control circuitry coupled to the power supply and the motor, and a shaft connected at a first end of the motor. The control circuitry is configured to receive electrical power from the power supply, sense an ambient pressure, and send a signal to the motor based on the ambient pressure. The shaft is connected at a second end to a first coupling, the first coupling configured to mate with a second coupling. The body of the personal vaporizer is configured to be coupled with a cartridge that includes a movable wall, and the second coupling actuates the movable wall.

Implementations can optionally include one or more of the following features.

In some instances, the cartridge includes a housing that the moveable wall translates within, an atomization chamber; a chimney extending form the atomization chamber through a mouthpiece to an external space; a reservoir configured to contain a substance to be atomized and including a volume defined by the atomization chamber, the housing, the chimney, and the movable wall; and a hollow screw partially enclosing the chimney and extending through the atomization chamber. The hollow screw including the second coupling disposed at a first end.

In some instances, the hollow screw is configured to rotate about an axis defined by the chimney, and the movable wall is engaged with threads of the hollow screw and configured to translate in response to the hollow screw rotating.

In some instances, the control circuitry includes a pressure sensor configured to sense an ambient pressure, an accelerometer, and a controller configured to actuate the motor to rotate.

In some instances, the control circuitry includes manual controls, and the controller receives commands from the manual controls and actuates the motor based on the commands. In some instances, the controller confirms, using the accelerometer, that the vaporizer is in an upside down orientation prior to actuating the motor in response to a wall raise command from the manual controls.

In some instances, the motor includes a position sensor that detects a position of the shaft.

This disclosure describes a method for controlling a movable wall in a personal vaporizer, the method including: monitoring an ambient pressure by a controller; determining, using the controller, that an ambient pressure is decreasing from a threshold pressure based on the monitored ambient pressure; identifying that the personal vaporizer is in an upright position using an accelerometer; and sending a control signal to the motor to adjust the movable wall from a first position to a second position to cause a volume of the reservoir containing a substance to be atomized to increase, reducing a differential pressure between the reservoir and the ambient pressure.

In some instances, the controller determines that the ambient pressure is returning to the threshold pressure. The controller identifies from the accelerometer that the personal vaporizer is in an upside down position and sends a control signal to the motor to adjust the movable wall back to the first position, to cause the volume of the reservoir to decrease.

In some instances, an input from a wall control on the personal vaporizer requesting lowering of the movable wall is received prior to the controller sending the control signal.

In some instances, the threshold pressure is an absolute pressure in the range of 14.0 to 14.6 pounds per square inch.

In some instances, the movable wall is continuously adjustable between the first and the second positions, and the motor adjusts the movable wall to an intermediate position based on the ambient pressure.

The details of these and other aspects are set forth in the accompanying drawings and the description below. Other features, objects, and advantages will be apparent from the description and drawings, and from the claims.

DETAILED DESCRIPTION

This disclosure describes a personal vaporizer such as an electronic cigarette, a vape pen, vape kits, e-cig, or e-hookah, electronic nicotine delivery system that includes a movable ceiling, which can be adjusted to compensate for changes in ambient barometric pressure. Personal vaporizers can provide controlled substances (e.g., nicotine, Tetrahydrocannabinol (THC), Cannabidiol (CBD), etc.). In many personal vaporizers, a wick transports the substance to be atomized from a reservoir to an atomization chamber via capillary action. This wick can be located near the bottom of the cartridge when the personal vaporizer is held in an upright position (e.g., during use). In normal conditions, the flow path from the reservoir along the wick to the atomization chamber is small enough that surface tension of the substance prevents leakage. However, if there is a sufficient differential pressure between the atomization chamber, typically at ambient pressure, and the reservoir, the substance can leak from the reservoir into the atomization chamber without being drawn out by airflow (e.g., the user inhaling on the mouthpiece). For example on a commercial airplane at cruising altitude, the cabin pressure is reduced to about 11 PSIA. If a personal vaporizer were brought on the flight, this would result in a differential pressure between the reservoir and the atomization chamber of approximately 3 PSI, which could force fluid to leak into the atomization chamber. A movable wall within the cartridge of the personal vaporizer can be used to adjust the volume of the reservoir, and reduce differential pressure between the reservoir and the ambient pressure, minimizing or eliminating unwanted leaks due to pressure changes.

Figure 1:
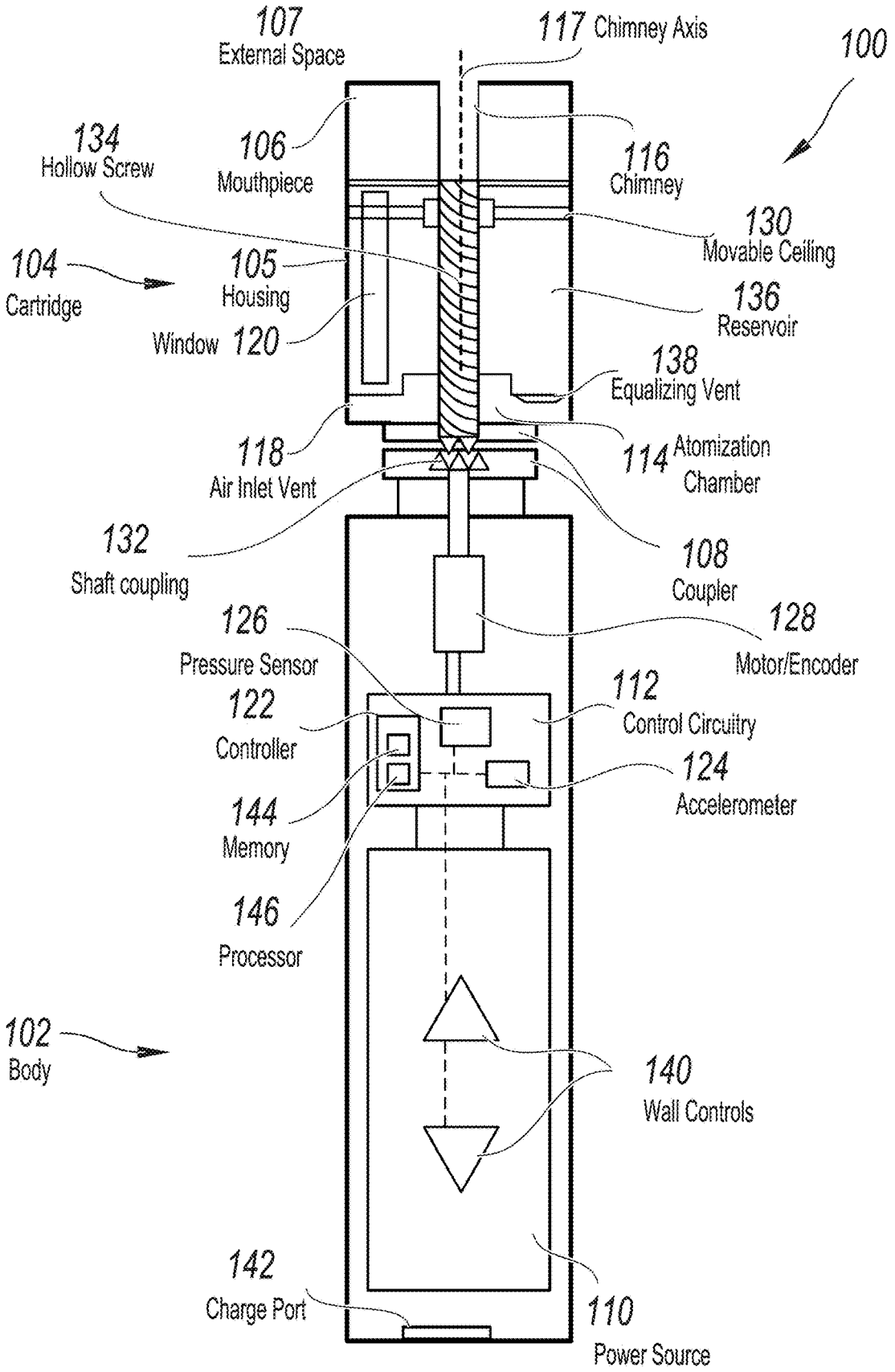
FIG. 1 illustrates a schematic, partial cross-sectional view of an example personal vaporizer, with some internals shown.

FIG. 1 illustrates a schematic view of an example personal vaporizer 100, with some internals shown. Personal vaporizer 100 includes a body portion 102, cartridge 104, and mouthpiece 106. In the illustrated implementation, the mouthpieces 106 is integral to the cartridge 104. In the illustrated implementation, the cartridge 104 is removable from the body 102 via a coupler 108. The illustrated coupler 108 has two parts, one that is part of the cartridge portion or mouthpiece portion 104 and one that is part of the body portion 102, e.g., one part being female and configured to receive the other, male, part. In certain instances, the coupler 108 is, for example, threads, a lug/channel connector, a recessed magnetic connector, or other suitable manner for coupling the two portions of the personal vaporizer 100. In addition, an electrical connection can also be facilitated in the connection between the coupler 108. Similarly, in some instances, the mouthpiece 106 is removable from the cartridge 104 via a similar coupler or a different coupler (not shown).

The body 102 includes a power source 110, which provides electrical power to control circuits 112, and a heating element in the atomization chamber 114. In some implementations, the power source 110 includes a battery, such as a lithium ion (Li-ion), nickel metal hydride (NiMH), Alkaline, or other battery. In some implementations, the battery is user replaceable. In some implementations, the battery is integrated with the body 102. Power source 110 can also include charging circuitry required for recharging the battery. A charging port 142 can be provided on the body 102, to allow recharging of the power source 110 as well as communications between the personal vaporizer 100 and external systems. The charging port 142 can be, for example, a USB-C, Micro-USB, 2.5 mm port, or other suitable port for providing electrical power and/or data to the personal vaporizer 100.

Control circuitry 112 includes necessary circuitry to operate the personal vaporizer 100. Control circuitry 112 can include one or more microcontrollers, or analog circuits, as well as sensors for operation. A puff sensor (not shown) can be provided in the control circuitry 112, which detects whether or not a user is drawing on the mouthpiece. The puff sensor can be a microphone, or a diaphragm based pressure sensor, or other pressure sensor. In some implementations, the control circuitry 112 can detect whether or not a cartridge is installed. In some instances, the control circuitry 112 can communicate systems external to the personal vaporizer 100, for example, control circuitry 112 can provide battery state of charge, or remaining substance level in the cartridge to a user's mobile device (e.g., via bluetooth, WIFI, or USB connection).

Control circuitry 112 includes a controller 122, an accelerometer 124, and a pressure sensor 126. The pressure sensor 126, configured to output a signal indicative of the ambient pressure. For example, pressure sensor 126 can be an MLDX-L05D-DX01-N series DIP pressure sensor, or other pressure sensor, which can be integrated into the control circuitry 112, or a separate sensor. The pressure sensor 126 is at least partially exposed to the ambient pressure. For example, a sensing line, or small tube can extend from the pressure sensor outside of the body 102. In some implementations, the body 102 is not sealed, and pressure inside the body 102, and ambient pressure acts directly on the circuit board and pressure sensor 126. Although shown residing in the body 102, in some implementations, pressure sensor 126 is installed in the cartridge 104, and provides a pressure signal to the control circuitry 112 via the coupler 108. Accelerometer 124 can be a sensor which provides a signal based on a sensed gravitational field. In some implementations accelerometer 124 includes a group of sensors. For example, accelerometer 124 can include a 3-axis accelerometer as well as a 3-axis gyroscope, and additional circuitry to provide an orientation of the sensor (and therefore the personal vaporizer 100). In some implementations, additional circuitry, or processing is done by the controller to determine orientation, based on raw data provided by accelerometer 124.

Controller 122 reads and operates various sensors (e.g., accelerometer 124 and pressure sensor 126) and outputs control signals to a motor 128, which can be a brushed or brushless, DC or AC motor. In some implementations, motor 128 includes an encoder, which provides rotational position to the controller 122 as an additional sensor. In some implementations, motor 128 is a stepper motor, which travels to a commanded position based on signals from the controller 122. The motor 128 can include any suitable position sensor. The controller 122 can use the encoder to determine motor position, and therefore the position of a movable wall 130, which in the illustrated example is presented as a ceiling. In some implementations, the controller 122 provides control signals to a separate motor driver board (not shown). In other implementations, the controller 122 directly powers the motor 128. Controller 122 includes a memory 144 and one or more processors 146.

The memory 144 of the controller 122 can represent a single memory or multiple memories. The memory 144 can include any memory or module and can take the form of volatile or non-volatile memory including, without limitation, magnetic media, optical media, random access memory (RAM), read-only memory (ROM), removable media, or any other suitable local or remote memory component. The memory 144 can store various objects or data, including current sensor readings, historical readings, trends, setpoints, caches, applications, backup data, and any other appropriate information associated with the controller 122, including any parameters, variables, algorithms, instructions, rules, constraints, or references thereto. Additionally, the memory 144 can store any other appropriate data, such as firmware logs and policies, firewall policies, a security or access log, as well as others.

Although illustrated as a single processor 146 in FIG. 1, multiple processors can be used according to particular needs, desires, or particular implementations of the personal vaporizer 100. Each processor 146 can be a central processing unit (CPU), an application specific integrated circuit (ASIC), a field-programmable gate array (FPGA), or another suitable component. Generally, the processor 146 executes instructions and manipulates data to perform the operations of the personal vaporizer 100. Specifically, the processor 146 executes the algorithms and operations described in the illustrated figures, as well as the various software modules and functionality, including the functionality sensing pressure and operating movable ceiling 130. Each processor 146 can have a single or multiple core, with each core available to host and execute an individual processing thread. Further, the number of, types of, and particular processors 146 used to execute the operations described herein can be dynamically determined based on a number of requests, interactions, and operations associated with the personal vaporizer 100.

In some implementations, the control circuitry 112 includes purely analog circuits. In some implementations the control circuitry 112 is a combination of digital circuitry and analog circuitry.

In some implementations, controller 122 also receives inputs from one or more wall controls 140, which can be mechanical switches, buttons, knobs, a touch screen or other type of input that allows the user to manually control the position of the movable wall 130 (illustrated in FIG. 1 as a movable ceiling 130). In some implementations, the wall controls 140 are interlocked with the accelerometer 124. For example, the controller 122 can suppress a signal from the wall controls 140 to lower the movable ceiling 130 unless the accelerometer 124 indicates that the personal vaporizer 100 is in an upside down position. This example interlock prevents the user from inadvertently lowering the ceiling and forcing liquid, instead of gas, out of the cartridge.

Motor 128 rotates a shaft that releasably couples to a hollow screw 134 in the cartridge 104. A portion of a shaft coupling 132 is affixed to one end of the motor shaft. The shaft coupling 132 can be configured to align and couple the motor shaft with hollow screw 134 in the cartridge 104. In some implementations, this coupling occurs when the cartridge 104 is connected to the body 102. In certain instances, shaft coupling 132 is a flange, which is shaped to self align and mate with a portion of the coupling on the cartridge 104. In some instances, the shaft coupling 132 is a magnetic coupling, or a frictional coupling, among other things.

Cartridge 104 includes an atomization chamber 114, through which air flows past a heating element and a wick that is exposed to a substance to be atomized. The atomized vapor can leave the vaporization chamber with the flowing air up through a passage or chimney 116. Cartridge 104 further includes a reservoir 136 that contains the substance to be atomized. A portion of reservoir 136 is surrounded by housing 105. In some implementations, a puff sensor is located in the cartridge 104 to sense when a user draws on the mouthpiece 106, and communicates with control circuitry 112 when the cartridge 104 is coupled with the body 102. One or more air inlet vents 118 are provided on the cartridge 104 for allowing airflow into the cartridge 104 when the user draws on the mouthpiece 106. In some implementations, the reservoir 136 includes a clear or translucent window 120 to the exterior of the cartridge 104 for visually determining the amount of substance within the reservoir. While illustrated as a relatively small window 120, in some implementations, an external shell of the cartridge 104 is formed of a translucent or transparent material, resulting in a window 120 that covers a majority of the exterior of the cartridge 104.

Mouthpiece 106 includes the chimney 116 and provides a flow path through the atomization chamber 114 into the user's mouth or an external space 107 when the mouthpiece is coupled to the cartridge 104. As illustrated in FIG. 1, in certain instances the cartridge is integral with the body 102 and the mouthpiece 106 couples directly to the body 102. The mouthpiece 106 can have a rubberized or textured outer surface to increase comfort and aid in the user achieving a seal between the mouthpiece 106 and their lips.

Hollow screw 134, when mated with the motor 128 via the shaft coupling 132 can rotate about a longitudinal axis 117 defined by the chimney 116. In the illustrated implementations, the hollow screw passes through the atomization chamber 114, and encircles a portion of the chimney 116. An outer surface of the hollow screw 134 is threaded, and configured to engage the movable ceiling 130. The movable ceiling 130 can form a seal with the outer edge of the cartridge 104 and define an upper boundary of the reservoir 136. When the hollow screw 134 is rotated, it causes the movable ceiling 130 to translate up or down, altering the volume of the reservoir 136. An equalizing vent 138, can be a vent which allows gas to pass, while inhibiting liquid. For example, equalizing vent 138 can include one or more micro-orifices, or a semi-permeable membrane, which allows air to pass, but prevents leakage of the substance within the reservoir. The equalizing vent 138 can allow air to enter or escape from the cartridge 104 when the movable ceiling 130 translates. In some implementations, the equalizing vent 138 is not necessary, and gas enters or escapes the cartridge via the capillary wick.

Figures 2A, 2B, 2C:
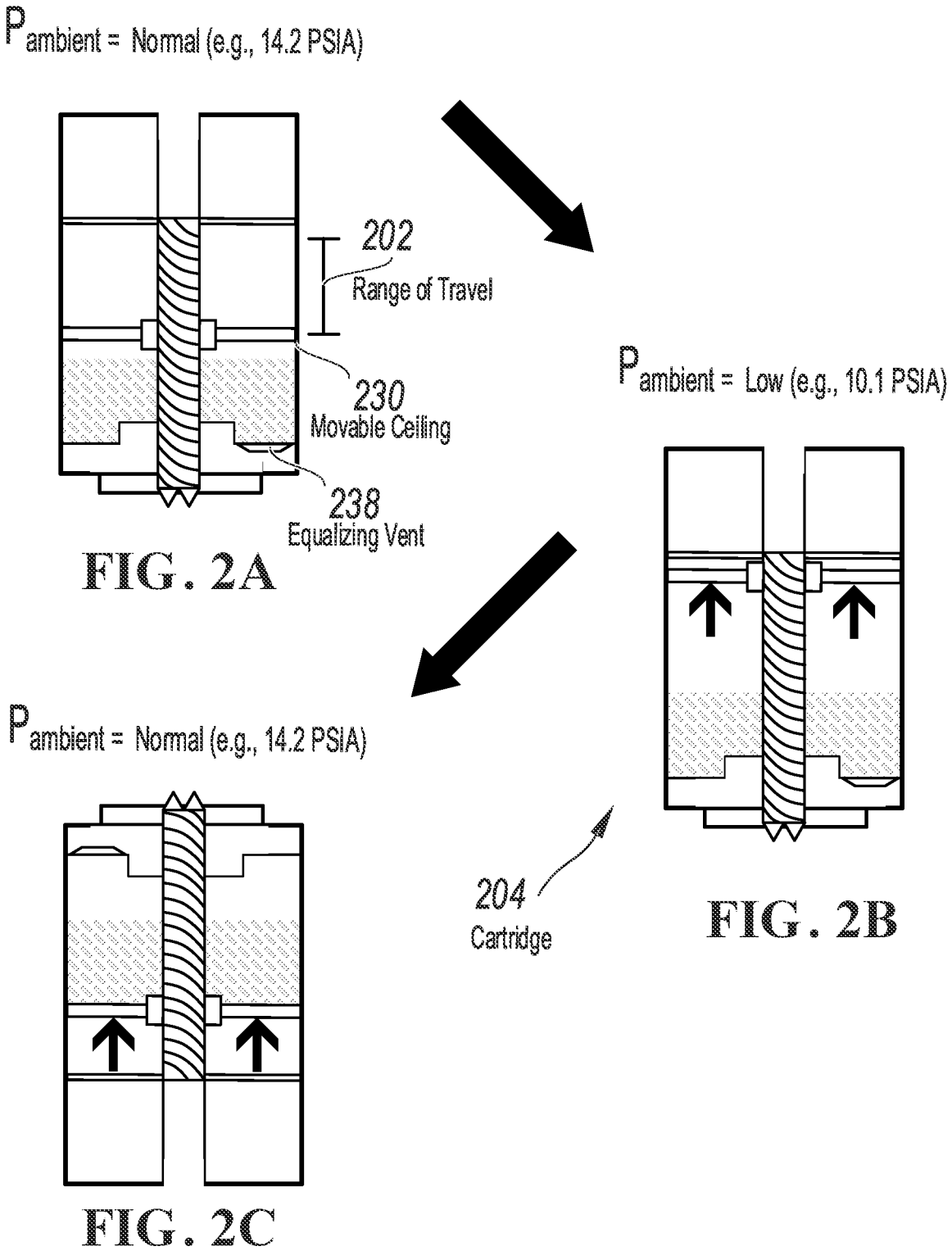
FIGS. 2A, 2B, and 2C illustrate an example scenario with a moving wall of a personal vaporizer cartridge.

FIGS. 2A, 2B, and 2C illustrate an example scenario with a moving ceiling of a personal vaporizer cartridge. In FIG. 2A, ambient pressure is at a first atmospheric pressure. For example, 14.7 PSIA. The cartridge is in an upright position, and the substance, as indicated by the shaded region, rests on the bottom of the reservoir, wetting the wick. The movable ceiling 230 is positioned at a lower limit of its range of travel 202. In some implementations, when a new cartridge is installed on a personal vaporizer (e.g., personal vaporizer 100 of FIG. 1), the controller in the personal vaporizer assumes the movable ceiling 230 is at the lower limit of its range of travel 202. In other implementations, the controller performs a calibration or test, to position the movable ceiling 230 in its appropriate location (e.g., based on ambient pressure). In FIG. 2B, the ambient pressure has decreased. For example, the cartridge may have changed altitude (e.g., on an airplane, or traversing up a mountain), or a weather front (e.g., thunderstorm) may have caused a drop in local ambient pressure. In response to sensing the reduced ambient pressure, the personal vaporizer has raised the movable ceiling 230, to reduce the internal pressure of the reservoir, preventing fluid from flowing out of the reservoir. FIG. 2C illustrates a reset condition, where the ambient pressure has returned to the first pressure. The cartridge 204 is inverted in FIG. 2C, allowing the substance within to rest on the movable ceiling, and any gas in the reservoir to travel to the top, and escape through either the capillary or the equalizing vent 238. In this inverted position, the movable ceiling 230 can be returned to its original position, pressing gas out either the equalizing vent 238 or the capillaries, without inadvertently expelling liquid.

In some implementations, the ceiling is moved manually by the controller, in response to controls (e.g., wall controls 140) on the personal vaporizer. In some implementations the entire process is automated, and the personal vaporizer automatically strives to maintain an equal or near equal pressure between the reservoir and ambient. Alternatively, a portion of the process can be automated. For example, the ceiling may automatically raise in response to low ambient pressure, preventing leakage with no user input. In this example, lowering or resetting the ceiling can be completed manually. The user can invert the personal vaporizer, and the cartridge, and press a "reset" button, a "lower" button, or a down arrow (e.g., down arrow of wall controls 140), causing the movable ceiling to return to its normal position.

In some implementations, the personal vaporizer can control the movable ceiling 230 height continuously or near continuously (e.g., in 5, 10, 20, or other number of preset positions along the range of travel). For example, the range of travel 202 of the movable ceiling 230 can be delineated from 0% at the lower limit, to 100% at the upper limit. The cartridge 204 can be configured to be operable for a range of ambient pressures (e.g., 14 PSIA to 10 PSIA). When the barometric pressure is at the upper end of the range (e.g., 14 PSIA) the personal vaporizer positions the movable ceiling 230 at 0%. If, for example, ambient pressure decrease to a midpoint of the operable range (e.g., 12 PSIA), the personal vaporizer can move the movable ceiling 230 to 50% of its range of travel. If pressure returns to normal, the personal vaporizer can wait for opportunities to lower the movable ceiling 230 back to 0%. For example, when the user places the personal vaporizer upside-down in their pocket, the movable ceiling 230 can be returned to the 0% position.

Figure 3:
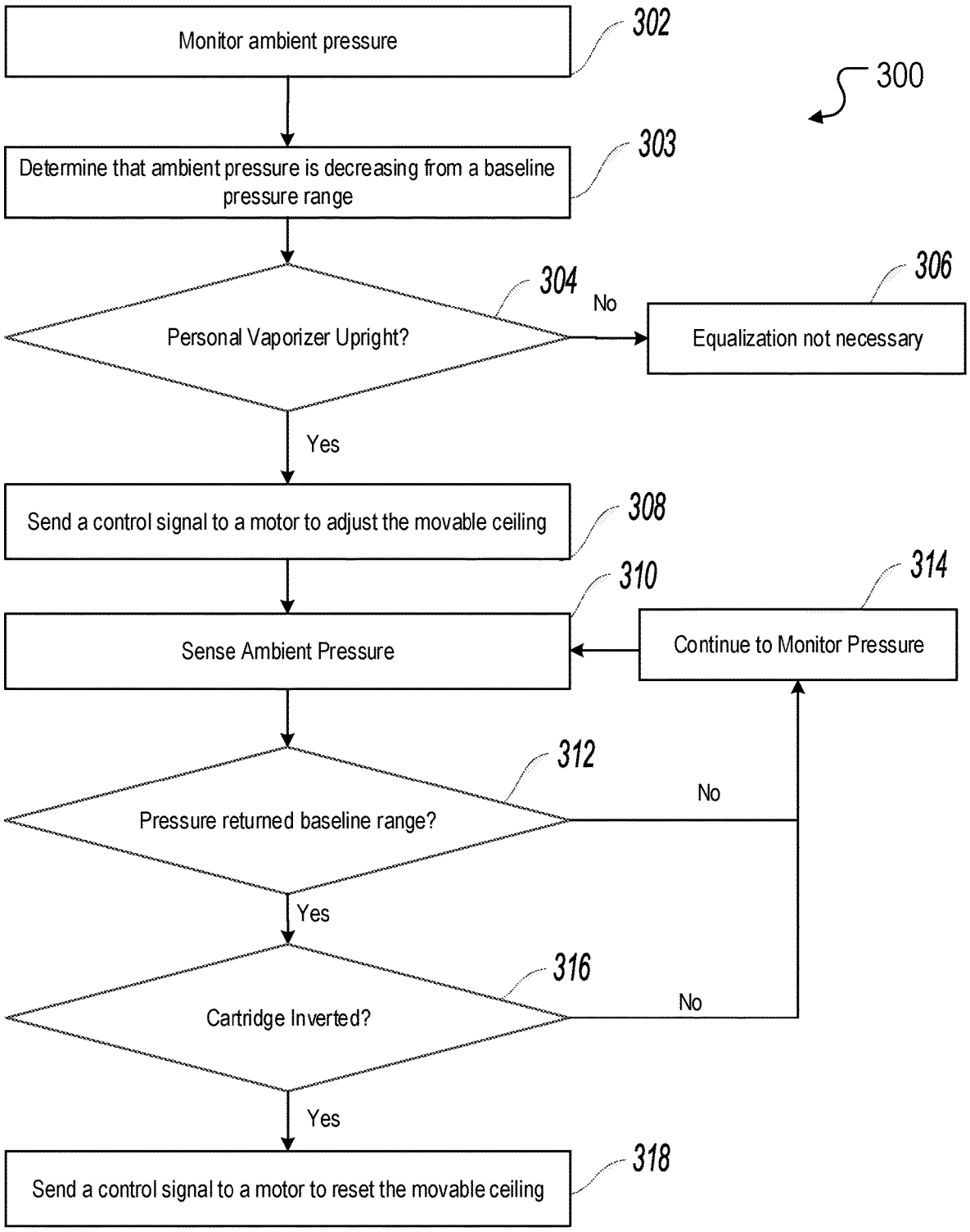
FIG. 3 is a flowchart illustrating an example method of controlling a personal vaporizer with a movable wall.

FIG. 3 is a flowchart illustrating an example method of controlling a personal vaporizer with a movable ceiling. FIG. 3 generally describes process 300 for adjusting a movable ceiling within the cartridge of a personal vaporizer, for example, personal vaporizer 100 of FIG. 1. Process 300 can be executed by, for example, controller 122 of FIG. 1, or control circuitry 112.

At 302, a controller (e.g., controller 122) uses a pressure sensor (e.g., pressure sensor 126) to monitor ambient pressure. In some implementations, the controller polls the pressure sensor periodically (e.g., every minutes, or every 5 minutes, or other interval). In some implementations, the pressure sensor triggers the controller if ambient pressure leaves a predetermine range.

At 303, an indication that ambient pressure is decreasing is received. This can be, for example, a sensed pressure that falls below a threshold pressure. The threshold pressure can be a range associated with normal barometric pressure fluctuations, or a pressure range within which the cartridge will not leak. For example, the threshold pressure can be 14.4 PSIA.

At 304, a determination is made as to the orientation of the personal vaporizer. For example, a controller can receive inputs from an accelerometer (e.g. accelerometer 124 of FIG. 1), and determine an orientation of the personal vaporizer relative to the gravity field. If the personal vaporizer is not in a substantially upright orientation (e.g., greater than 45 degrees from the vertical) no equalization is necessary. In some implementations, upright, means the cartridge end of the personal vaporizer is generally pointing away from the gravity field. Gas in the reservoir which may be at a higher pressure than the recently reduced ambient pressure can escape via the capillary or equalization vent, as the substance in the cartridge will not be blocking them. In some implementations, the personal vaporizer is determined to be upright if it forms an angle with respect to the vertical of less than 45 degrees. In some implementations, this angle can be greater or less. In some implementations, the required angle to be upright increases as the liquid level based on a level sensor in the cartridge decreases. For example, a nearly full cartridge may be closer to horizontal and still block the capillaries/equalization vent and a nearly empty cartridge. If the personal vaporizer is not upright, at 306, process 300 stops, the cartridge is assumed to be equalized.

At 308, if the personal vaporizer is upright, a control signal is sent to a motor to adjust the movable ceiling. In some implementations, the control signal is a pulse width modulated signal provided to a motor driver board which operates a motor. In some implementations, the control signal is a command to a stepper motor. In some implementations, the control signal is directly applying a voltage to a motor. The movable ceiling can be moved from a first position to a second position, where the second position results in an increased reservoir volume and therefore a reduced reservoir pressure. In some implementations, the second position is calculated based on the ambient pressure, and is determined to minimize a differential pressure between the ambient and the reservoir. In some implementations, the second position is a preset position, selected based on a sensed ambient pressure. In some implementations, the second position is a preset distance from the first position, and process 300 iterates. For example, the movable ceiling can be moved to the second position, then an additional ambient pressure reading, as well as orientation reading is taken to confirm the personal vaporizer is still upright, and if necessary, 308 is repeated.

At 310, ambient pressure is sensed. In some implementations, a pressure sensor (e.g., pressure sensor 126) is polled by a controller periodically. For example every 10 seconds, 1 minutes, 5 minutes, or other interval. In some implementations, a trend can be established and the polling interval can be adjusted based on the trend. For example, if pressure has been relatively static, the polling interval can be increased in order to conserve energy. If the pressure is dynamic, the polling interval can be decreased, to ensure accurate and up-to-date readings are available.

At 312, it is determined whether the pressure is returning to, or has returned to within the threshold range. If the pressure has not returned to within the threshold range, then ambient pressure is monitored at 314. If pressure has returned to within the threshold range, it is determined whether the cartridge is inverted (or cartridge pointing generally toward the gravity field) at 316. In some implementations, similar to determining if the cartridge is upright, the angle required for determining the cartridge is inverted can vary based on the liquid level in the cartridge, such that it is assured the liquid is no longer covering the vent or capillaries. If the cartridge is not inverted, the personal vaporizer continues to monitor pressure (314).

At 318, if the pressure has returned to within the threshold range and the personal vaporizer or cartridge is inverted, a control signal is sent to the motor to reset the movable ceiling. For example, the movable ceiling can be returned to the first position. In some implementations, where pressure has risen, but entirely returned to its original value, the movable ceiling is only partially reset, providing additional range of travel for the movable ceiling without pressurizing the cartridge. For example, if the personal vaporizer is on an airline, which has descended from 40,000 ft to 30,000 ft, the movable ceiling can be reset to 50% (e.g., 2 cm of 4 cm range of motion) based on the ambient pressure returning halfway to its original pressure.

Although this disclosure has been described in terms of certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of this disclosure.

The invention claimed is:

1. A personal vaporizer comprising:

a body comprising:

a power supply;

a motor;

control circuitry coupled to the power supply and the motor, the control circuitry configured to receive electrical power from the power supply, sense an ambient pressure, and send a signal to the motor based on the ambient pressure, the control circuitry comprising an accelerometer and a controller configured to actuate the motor to rotate; and a shaft connected at a first end to the motor, and at a second end to a first coupling configured to mate with a second coupling;

wherein the body is configured to couple with a cartridge that comprises a movable wall, and wherein the second coupling actuates the movable wall, and wherein in response to a command to raise the movable wall, the controller is configured to confirm, using the accelerometer, that the personal vaporizer is in an upside-down orientation prior to actuating the motor.

2. The personal vaporizer of claim 1, wherein the cartridge comprises:

a housing, wherein the movable wall is configured to translate within the housing;

an atomization chamber;

a chimney extending from the atomization chamber through a mouthpiece to an external space;

a reservoir configured to contain a substance to be atomized, the reservoir comprising a volume defined by the atomization chamber, the housing, the chimney, and the movable wall; and a hollow screw partially enclosing the chimney and extending through the atomization chamber, the hollow screw comprising the second coupling disposed at a first end of the hollow screw.

3. The personal vaporizer of claim 2, wherein the hollow screw is configured to rotate about an axis defined by the chimney, wherein the movable wall is engaged with threads of the hollow screw, and configured to translate in response to the hollow screw rotating.

4. The vaporizer of claim 1, wherein the control circuitry comprises:

a pressure sensor configured to sense the ambient pressure.

5. The vaporizer of claim 4, the control circuitry comprising:

manual controls, wherein the controller is configured to receive commands from the manual controls and actuate the motor based on the commands.

6. The vaporizer of claim 5, wherein the command to raise the wall is received from the manual controls.

7. The vaporizer of claim 1, wherein the motor comprises a position sensor, configured to detect a position of the shaft.

8. A method for controlling a movable wall in a personal vaporizer, the method comprising:

monitoring, by a controller, an ambient pressure;

determining, by the controller, that an ambient pressure is decreasing from a threshold pressure based on the monitored ambient pressure;

identifying, from an accelerometer, that the personal vaporizer is in an upright position; and sending a control signal to a motor to adjust the movable wall from a first position to a second position to cause a volume of a reservoir containing a substance to be atomized to increase, reducing a pressure differential between the reservoir and the ambient pressure;

determining, by the controller, that the ambient pressure is returning to the threshold pressure;

identifying, from the accelerometer, that the personal vaporizer is in an upside down position; and sending a control signal to the motor to adjust the movable wall back to the first position, to cause the volume of the reservoir to decrease.

9. The method of claim 8, comprising:

prior to sending the control signal to the motor to adjust the movable wall back to the first position, receiving an input from a wall control on the personal vaporizer requesting lowering of the movable wall.

10. The method of claim 8, wherein the threshold pressure is an absolute pressure in the range of 14.0 to 14.6 pounds per square inch.

11. The method of claim 8, wherein the movable wall is continuously adjustable between the first position and the second position, and wherein the motor adjusts the movable wall to an intermediate position based on the ambient pressure.

12. The method of claim 8, comprising:

prior to sending the control signal to the motor to adjust the movable wall from the first position to the second position, receiving an input from a wall control on the personal vaporizer requesting raising of the movable wall.

13. A system for controlling a movable wall in a personal vaporizer, the system comprising:

a cartridge with the movable wall;

a body configured to couple with the cartridge, the body comprising;

a power supply;

a motor;

control circuitry coupled to the power supply and the motor, the control circuitry configured to receive electrical power from the power supply, sense an ambient pressure, and send a signal to the motor based on the ambient pressure, the control circuitry comprising an accelerometer and a controller configured to actuate the motor to rotate, wherein in response to a command to raise the movable wall, the controller is configured to confirm, using the accelerometer, that the personal vaporizer is in an upside-down orientation prior to actuating the motor; and a shaft connected at a first end to the motor, and at a second end to a first coupling configured to mate with a second coupling, wherein the second coupling actuates the movable wall.

14. The system of claim 13, wherein the cartridge comprises:

a housing, wherein the movable wall is configured to translate within the housing;

an atomization chamber;

a chimney extending from the atomization chamber through a mouthpiece to an external space;

a reservoir configured to contain a substance to be atomized, the reservoir comprising a volume defined by the atomization chamber, the housing, the chimney, and the movable wall;

a hollow screw partially enclosing the chimney and extending through the atomization chamber, the hollow screw comprising the second coupling disposed at a first end.

15. The system of claim 14, wherein the hollow screw is configured to rotate about an axis defined by the chimney, wherein the movable wall is engaged with threads of the hollow screw, and configured to translate in response to the hollow screw rotating.

16. The system of claim 13, wherein the control circuitry comprises:

a pressure sensor configured to sense the ambient pressure.

17. The system of claim 16, the control circuitry comprising:

manual controls, wherein the controller is configured to receive commands from the manual controls and actuate the motor based on the commands.

18. The system of claim 17, wherein the command to raise the wall is received from the manual controls.

19. The system of claim 13, wherein the motor comprises a position sensor, configured to detect a position of the shaft.

* * * * *